US012276104B1

(12) United States Patent
Lee

(10) Patent No.: US 12,276,104 B1
(45) Date of Patent: Apr. 15, 2025

(54) PREFABRICATED BRACKET ASSEMBLY INTEGRATED TO PREFABRICATED COLUMN ASSEMBLY FOR CONNECTING PC BEAMS

(71) Applicants: SENVEX CO., LTD., Seoul (KR); SAMSUNG E&A CO., LTD., Seoul (KR)

(72) Inventor: Chang Nam Lee, Seoul (KR)

(73) Assignees: SENVEX CO., LTD., Seoul (KR); SAMSUNG E&A CO., LTD., Seoul (KR)

( * ) Notice: Subject to any disclaimer, the term of this patent is extended or adjusted under 35 U.S.C. 154(b) by 0 days.

(21) Appl. No.: 18/864,528

(22) PCT Filed: Jun. 12, 2023

(86) PCT No.: PCT/KR2023/008026
§ 371 (c)(1),
(2) Date: Nov. 10, 2024

(87) PCT Pub. No.: WO2023/243961
PCT Pub. Date: Dec. 21, 2023

(30) Foreign Application Priority Data

Jun. 13, 2022 (KR) ..... 10-2022-0071481

(51) Int. Cl.
*E04C 5/16* (2006.01)
*E04B 1/41* (2006.01)
*E04C 5/01* (2006.01)

(52) U.S. Cl.
CPC ..... *E04C 5/166* (2013.01); *E04B 1/41* (2013.01); *E04C 5/01* (2013.01); *E04B 2001/4192* (2013.01)

(58) Field of Classification Search
CPC . E04C 3/293; E04C 3/294; E04C 5/01; E04C 5/166; E04B 1/215; E04B 1/41;
(Continued)

(56) References Cited

U.S. PATENT DOCUMENTS 732,485 A * 6/1903 Wight ..... E04C 3/34 52/649.3
1,688,957 A * 10/1928 Bitney ..... B21F 27/125 52/649.3

(Continued)

FOREIGN PATENT DOCUMENTS

CN 108035443 A * 5/2018 ..... E04B 1/38
CN 111733881 A * 10/2020

(Continued)

OTHER PUBLICATIONS

International Search Report for PCT/KR2023/008026 mailed Sep. 14, 2023 from Korean Intellectual Property Office.

*Primary Examiner* — Jessica L Laux
*Assistant Examiner* — Joseph J. Sadlon
(74) *Attorney, Agent, or Firm* — Revolution IP, PLLC

(57) ABSTRACT

The present invention relates to a prefabricated bracket assembly integrated into a prefabricated column assembly for connecting PC beams, the end portions of PC beams being placed inside the prefabricated bracket assembly that is assembled on top of the prefabricated column assembly, into which concrete is poured so as to connect the PC beams and the prefabricated bracket assembly, thereby facilitating the connection of the PC beams to a factory-made prefabricated column assembly and allowing cost reduction.

1 Claim, 10 Drawing Sheets

(58) Field of Classification Search
CPC ..... E04B 2001/2406; E04B 2001/4192; E04B 2005/173; E04B 2005/176
USPC ..... 52/854, 648.1–649.3
See application file for complete search history.

(56) References Cited

U.S. PATENT DOCUMENTS 3,333,386 A * 8/1967 Mora ..... E04C 5/06 52/654.1
3,473,285 A * 10/1969 Reiland ..... E04C 5/163 52/649.3
3,744,207 A * 7/1973 Oroschakoff ..... B21F 27/121 52/649.3
3,863,416 A * 2/1975 Oroschakoff ..... E04C 5/04 52/646
3,971,179 A * 7/1976 Bodocsi ..... E04B 1/24 52/272
4,295,310 A * 10/1981 McManus ..... E04B 5/29 52/334
7,908,804 B2 * 3/2011 Vieira ..... E04C 3/02 52/204.2
8,291,676 B2 * 10/2012 Hong ..... E04C 3/293 52/340
8,661,755 B2 * 3/2014 Studebaker ..... E04B 1/22 52/657
8,915,042 B2 * 12/2014 Ahn ..... E04B 5/43 52/649.6
9,032,681 B1 * 5/2015 Brady ..... E04B 2/88 52/404.1
9,140,000 B1 * 9/2015 Brady ..... E04B 1/24
9,909,308 B2 * 3/2018 Kwon ..... E04C 5/065
9,945,123 B2 * 4/2018 Peltonen ..... E04B 1/14
10,465,374 B2 * 11/2019 Sugaya ..... E04C 5/06
10,648,167 B2 * 5/2020 Satchell ..... E04B 5/10
10,711,450 B2 * 7/2020 Green ..... E04B 1/388
10,900,220 B2 * 1/2021 King ..... E04B 1/19
11,686,084 B2 * 6/2023 Chen ..... E04B 1/215 52/745.19
11,946,245 B2 * 4/2024 Bowron ..... E04B 1/1903
12,110,683 B2 * 10/2024 Lim ..... E04C 5/18
2012/0137619 A1 * 6/2012 Martter ..... E04C 5/0645 52/649.1
2015/0267394 A1 * 9/2015 Houghton ..... E04C 3/32 52/854
2018/0320363 A1 * 11/2018 Hong ..... E04C 5/0645
2024/0254755 A1 * 8/2024 McCornack ..... E04B 1/165

FOREIGN PATENT DOCUMENTS

CN 112411609 A * 2/2021
FR 3110615 A1 * 11/2021 ..... E04B 1/4171
JP H06212691 A 8/1994
KR 20110032687 A * 3/2011 ..... E04B 1/30
KR 101233693 B1 2/2013
KR 20130074238 A 7/2013
KR 101458975 B1 11/2014
KR 101490748 B1 2/2015
KR 101661542 B1 10/2016
KR 20190123025 A 10/2019
KR 102277223 B1 * 7/2021 ..... E04C 3/293
WO WO-0126974 A2 * 4/2001 ..... E04C 5/0604
WO WO-2007099321 A1 * 9/2007 ..... E04B 2/84
WO WO-2016021811 A1 * 2/2016 ..... E04B 2/56

* cited by examiner

PREFABRICATED BRACKET ASSEMBLY INTEGRATED TO PREFABRICATED COLUMN ASSEMBLY FOR CONNECTING PC BEAMS

CROSS REFERENCE TO PRIOR APPLICATIONS

This application is a National Stage Application of PCT International Patent Application No. PCT/KR2023/008026 filed on Jun. 12, 2023, under 35 U.S.C. § 371, which claims priority to Korean Patent Application No. 10-2022-0071481 filed on Jun. 13, 2022, which are all hereby incorporated by reference in their entirety.

TECHNICAL FIELD

The present invention relates to a Prefabricated bracket assembly integrated to a prefabricated column assembly for connecting PC beams, in which an end portion of a PC beam is placed inside a prefabricated bracket assembly assembled on top of a prefabricated column assembly and then concrete is poured so that the prefabricated bracket assembly and the PC beam are joined, thereby facilitating joining factory-made prefabricated column assemblies and PC beams and reducing costs.

BACKGROUND ART

Reinforced concrete RC structures are constructed by installing the formwork and then placing reinforcing bars inside the formwork and pouring and curing concrete. At this time, since the reinforcement and formwork installation work is carried out on site, a lot of manpower is invested, the construction period takes a long time, and it is not easy to secure uniform quality. In addition, since a separate temporary material must be installed outside to support the form, and temporary material installation and disassembly processes are added, interference with the temporary materials may cause inconvenience to workers, and there is also a risk of safety accidents.

In particular, in the case of large structures, formwork installation or reinforcement work are performed at high locations, which reduces workability, increases the installation scale of the temporary materials as well as construction costs, and raises concerns about safety accidents.

In order to solve these problems of the conventional RC method, a formwork-integrated prefabricated column was developed, in which a lightweight permanent formwork is attached to a pre-fabricated column frame (Korean registered patent publication No. 10-1490748).

According to the above registered technology, a formwork is fixed to a highly rigid horizontal support member and an L-shaped steel member, wherein since the formwork is pre-attached at the factory and brought to the site, the on-site rebar placement work or formwork installation and disassembly processes can be greatly reduced, shortening the construction period. In addition, steel frame members are placed on the outside of columns so as to ensure excellent lateral performance, and the columns can easily stand on its own during installation. Furthermore, members are lightweight, so there is less lifting burden, and section steel members are embedded inside the concrete so there is no need for separate fireproofing treatment.

Meanwhile, when constructing a reinforced concrete structure, PC members can be used as beams connected to columns. PC beams can be manufactured in advance at the factory and brought in and installed on site, so the installation method thereof is simple and does not require separate fireproofing treatment.

However, in order to join a PC beam to an SRC column composed of a steel frame member and a reinforced concrete member, an H-beam column is placed inside the SRC column, a bracket is connected to the H-beam column in a "+" shape, and then the steel frame member, which is embedded in the end portion of the PC beam and protrudes outside, is joined to the "+"-shaped bracket (FIG. 5 of Korean registered patent publication No. 10-1233693).

However, this prior art requires multiple bolting joints in the field to join the steel frame member. In addition, since the work is carried out at heights, there is a risk of worker safety accidents and the work takes a lot of time.

Furthermore, since the H-beam steel column and the "+"-shaped bracket are provided inside the prefabricated column assembly, they interfere with each other when pouring concrete, which reduces construction efficiency, and a large amount of steel members is required, which increases the cost and reduces the manufacturability of the PC member.

DETAILED DESCRIPTION OF THE INVENTION

Technical Problems

In order to solve the above problems, the present invention is derived to provide a prefabricated bracket assembly integrated into a prefabricated column assembly for connecting a PC beam, which allows a PC beam to be easily joined to a factory-made prefabricated column assembly, thereby achieving excellent constructability.

The present invention is derived to provide a Prefabricated bracket assembly integrated to a prefabricated column assembly for connecting PC beams, which can be easily manufactured, reduce costs by saving the amount of steel members, and reduce the risk of worker safety accidents.

Problem Solving Means

According to a preferred embodiment, the present invention relates to a prefabricated bracket assembly, which is formed in a U shape with an open top portion and integrally provided with a prefabricated column assembly so as to connect PC beams to the prefabricated column assembly that includes first connecting bars connected to outer surfaces of vertical steel members, thereby interconnecting a plurality of vertical steel members arranged in the vertical direction at each corner of a column member and neighboring vertical steel members, and provides a Prefabricated bracket assembly integrated to a prefabricated column assembly for connecting PC beams, including: four horizontal steel members, which are spaced apart from each other in the up, down, left, and right directions, and penetrate a prefabricated column assembly in the horizontal direction so that both ends protrude to the outside of side surfaces of the prefabricated column assembly; second connecting bars for connecting horizontal steel members neighboring in the up and down directions and horizontal steel members neighboring in the left and right directions at the bottom, respectively; lightweight permanent formworks coupled to the outside of the second connecting bars on each face of side portions and lower portions of the horizontal steel members; a mounting bar, which are provided at lower portions of one pair of horizontal steel members located at the bottom so as to cross the one pair of horizontal steel members and has a cross-sectional size larger than that of the second connecting bars; and support pads provided on an upper surface of the mounting bar, wherein with an end portion of the PC beam accommodated inside so as to be mounted on upper surfaces of the support pads on the mounting bar, concrete is poured inside the lightweight permanent formworks so that the PC beam is joined.

According to another preferred embodiment, the present invention provides a Prefabricated bracket assembly integrated to a prefabricated column assembly for connecting PC beams, in which an upper support bar for preventing a PC beam accommodated inside from falling off is provided on upper portions of one pair of horizontal steel members located at the top so as to cross upper portions of the PC beams.

According to a further preferred embodiment, the present invention provides a Prefabricated bracket assembly integrated to a prefabricated column assembly for connecting PC beams, in which seats, on which horizontal steel members are mounted, are horizontally coupled to one pair of vertical steel members of a prefabricated column assembly on side surfaces where a prefabricated bracket assembly is coupled.

Effect of the Invention

According to the present invention, a prefabricated bracket assembly integrated into a prefabricated column assembly for connecting a PC beam can be provided, in which an end portion of a PC beam is placed inside a prefabricated bracket assembly, which is assembled integrally on top of a prefabricated column assembly, and then concrete is poured, so that the prefabricated bracket assembly and the PC beam can be easily joined.

Therefore, the PC beam can be quickly and easily joined to the factory-made prefabricated column assembly, improving constructability, minimizing the burden of lifting equipment, and reducing the risk of worker safety accidents.

In addition, it is easy to manufacture the prefabricated bracket assembly and the amount of steel members required during manufacture can be economically saved.

BEST MODE FOR CARRYING OUT THE INVENTION

In order to solve the above problems, a Prefabricated bracket assembly integrated to a prefabricated column assembly for connecting PC beams of the present invention relates to a prefabricated bracket assembly, which is formed in a U shape with an open top portion and integrally provided with a prefabricated column assembly so as to connect a PC beam to the prefabricated column assembly that includes first connecting bars connected to outer surfaces of vertical steel members, thereby interconnecting a plurality of vertical steel members arranged in the vertical direction at each corner of a column member and neighboring vertical steel members, and includes: four horizontal steel members, which are spaced apart from each other in the up, down, left, and right directions, and penetrate a prefabricated column assembly in the horizontal direction so that both ends protrude to the outside of side surfaces of the prefabricated column assembly; second connecting bars for connecting horizontal steel members neighboring in the up and down directions and horizontal steel members neighboring in the left and right directions at the bottom, respectively; lightweight permanent formworks coupled to the outside of the second connecting bars on each face of side portions and lower portions of the horizontal steel members; a mounting bar, which are provided at lower portions of one pair of horizontal steel members located at the bottom so as to cross the one pair of horizontal steel members and has a cross-sectional size larger than that of the second connecting bars; and support pads provided on an upper surface of the mounting bar, wherein with an end portion of the PC beam accommodated inside so as to be mounted on upper surfaces of the support pads on the mounting bar, concrete is poured inside the lightweight permanent formworks so that the PC beam is joined.

MODE FOR CARRYING OUT THE INVENTION

Hereinafter, the present invention will be described in detail according to the attached drawings and preferred embodiments.

Figure 1:
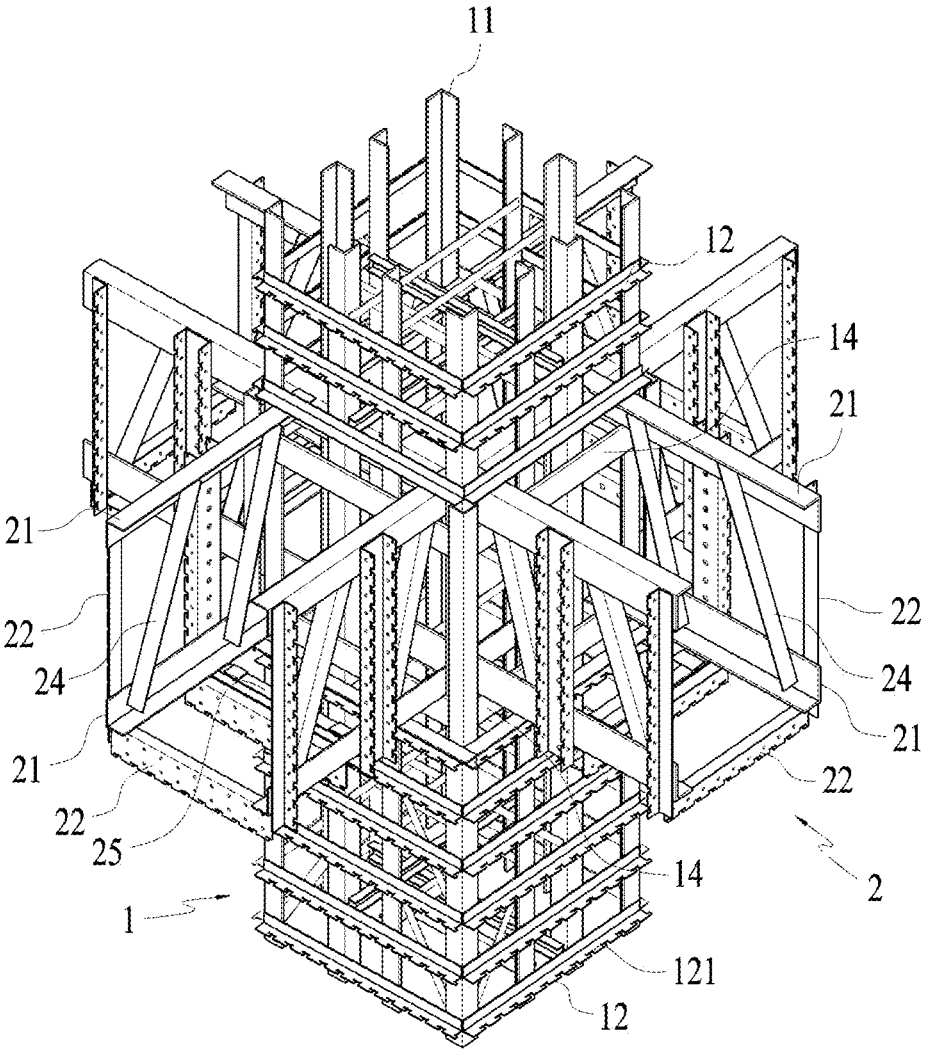
FIG. 1 is a perspective view showing a prefabricated column assembly integrally equipped with a prefabricated bracket assembly before joining a lightweight permanent formwork.
Figure 2:
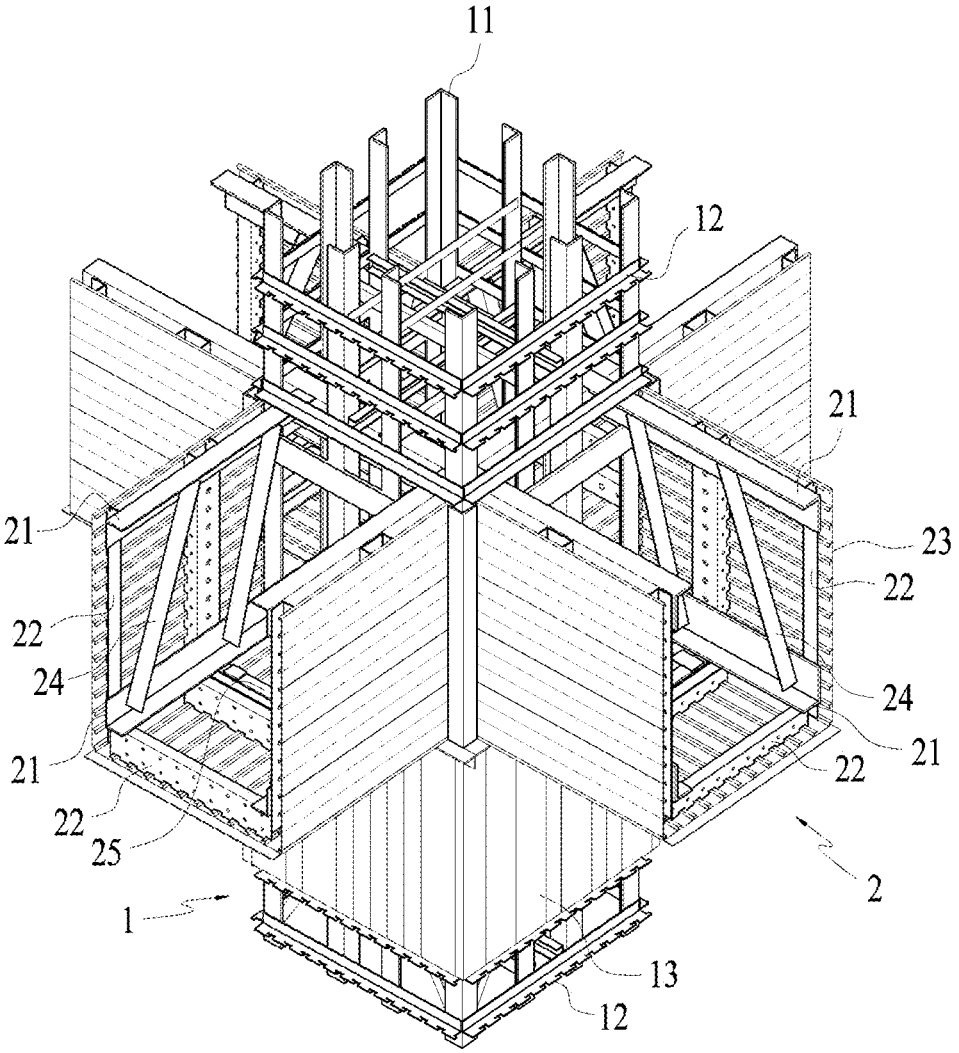
FIG. 2 is a perspective view showing a prefabricated column assembly integrally equipped with a prefabricated bracket assembly after joining a lightweight permanent formwork.
Figure 3:
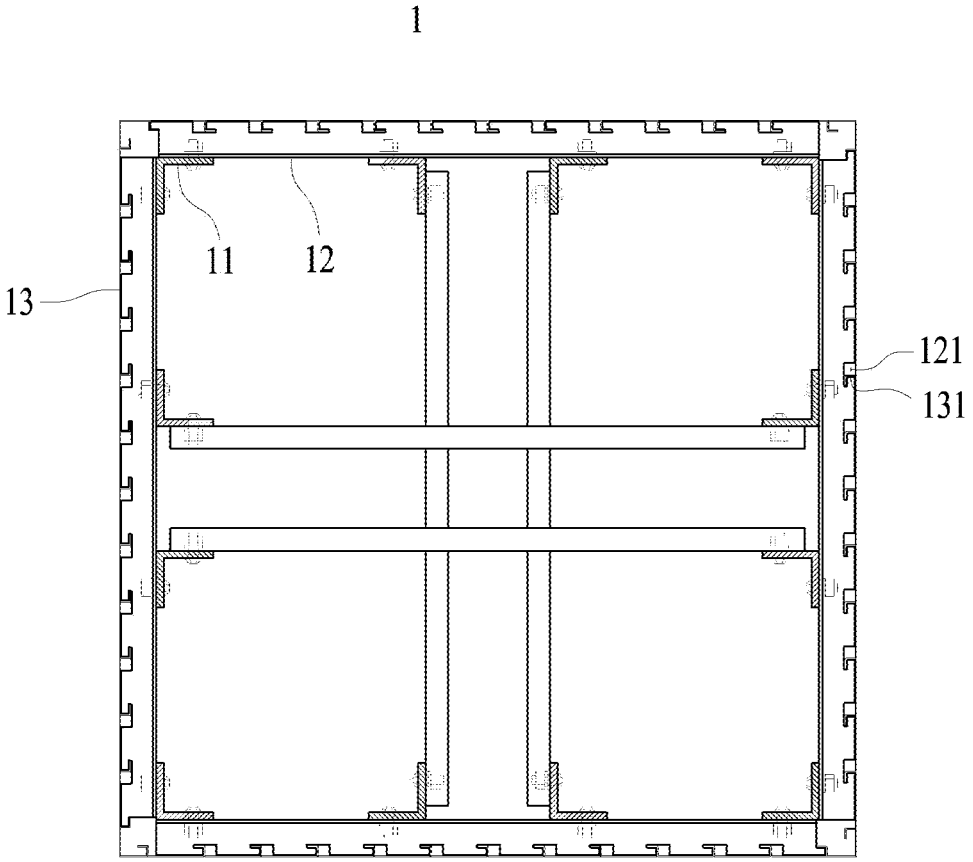
FIG. 3 is a plan cross-sectional view showing a prefabricated column assembly.
Figure 4:
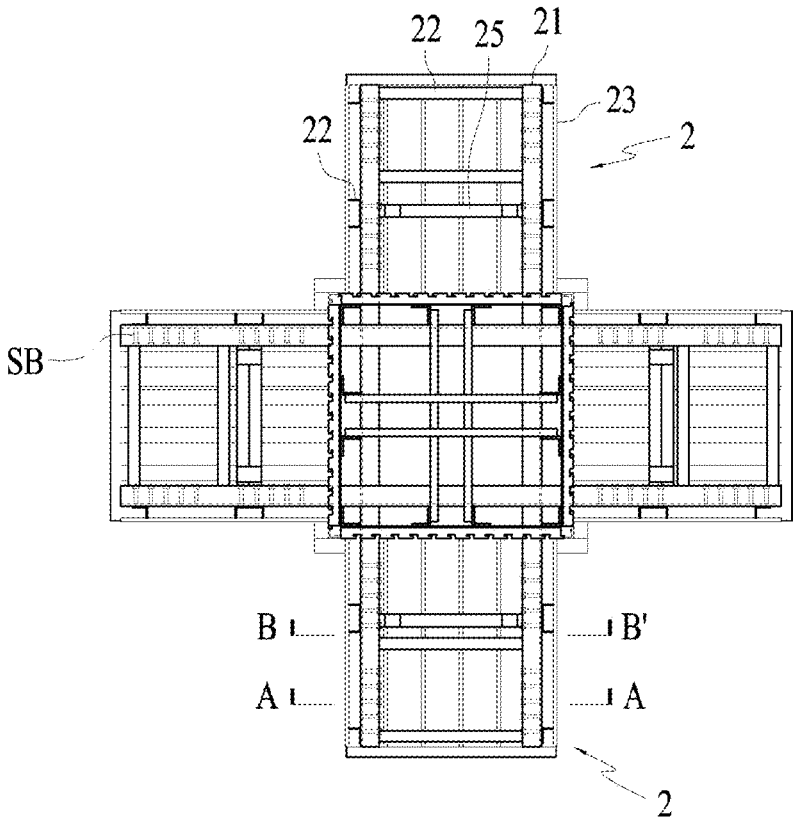
FIG. 4 is a plan view showing prefabricated bracket assemblies in a state combined with a prefabricated pillar assembly.
Figure 5:
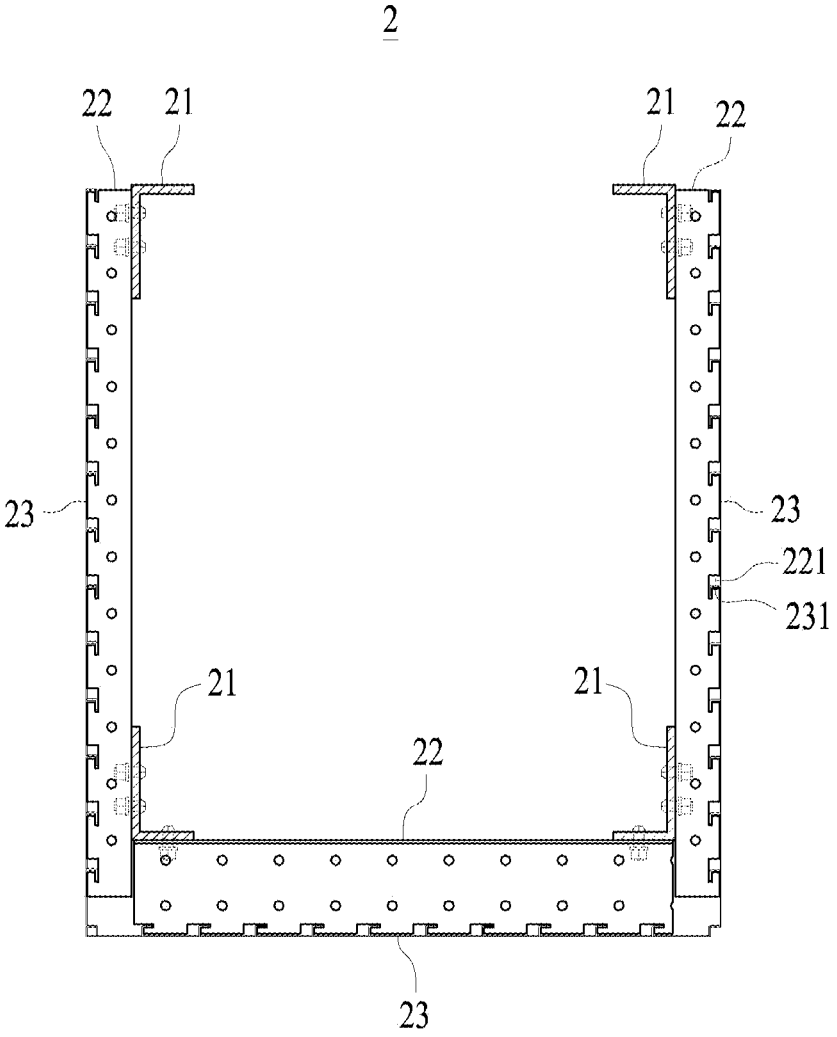
FIG. 5 is a cross-sectional view showing a cross-section taken along line A-A' in FIG. 4.
Figure 6:
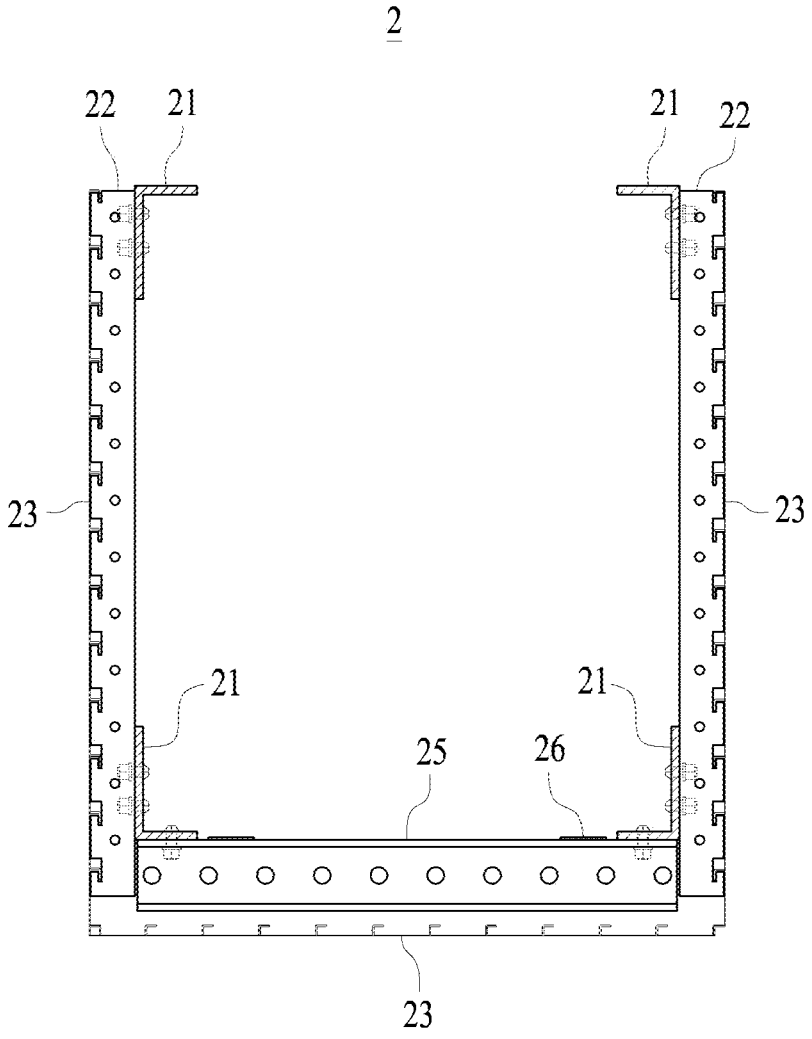
FIG. 6 is a cross-sectional view showing a cross-section taken along line B-B' in FIG. 4.
Figure 7:
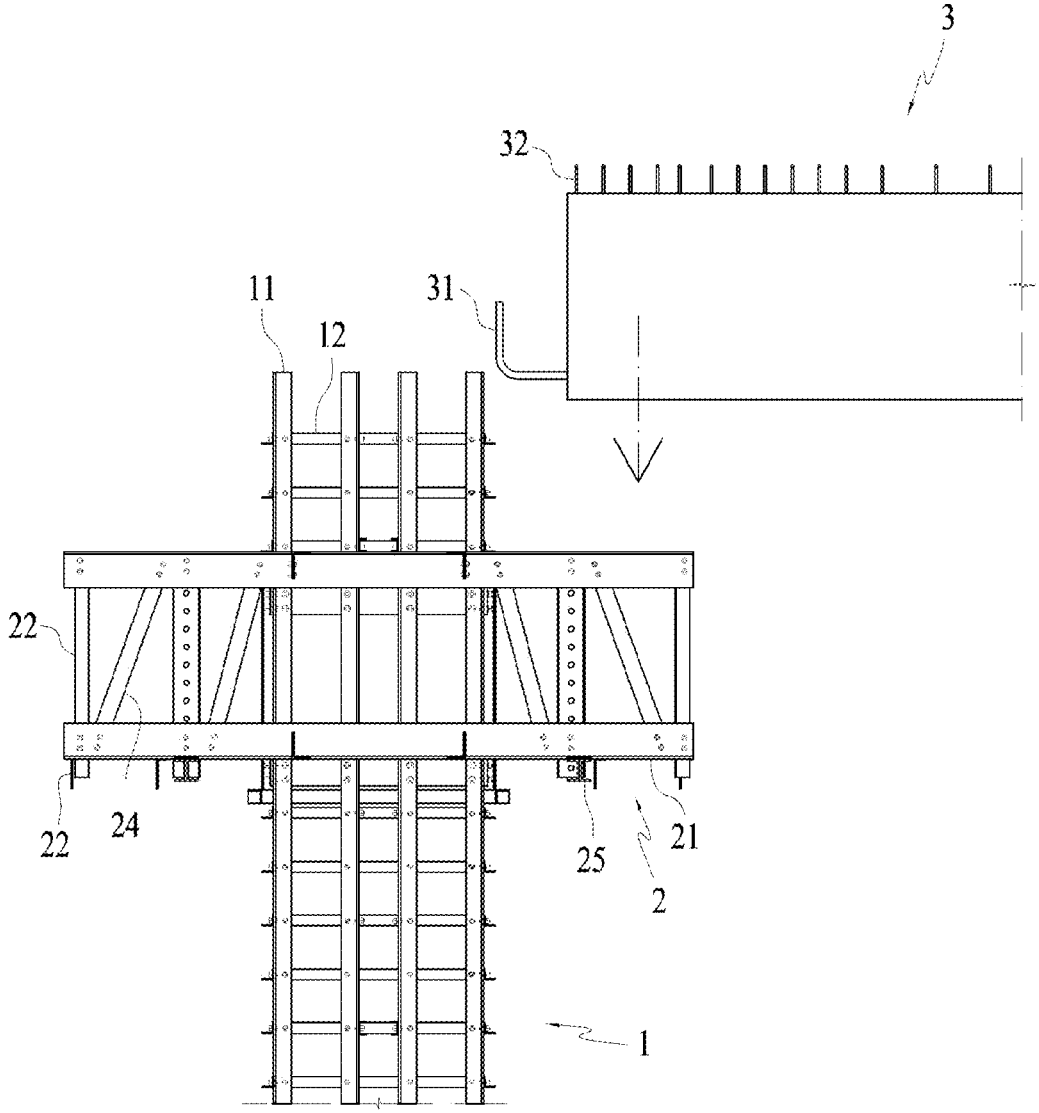
FIG. 7 is a side view showing a joining process of a prefabricated bracket assembly and a PC beam.
Figure 8:
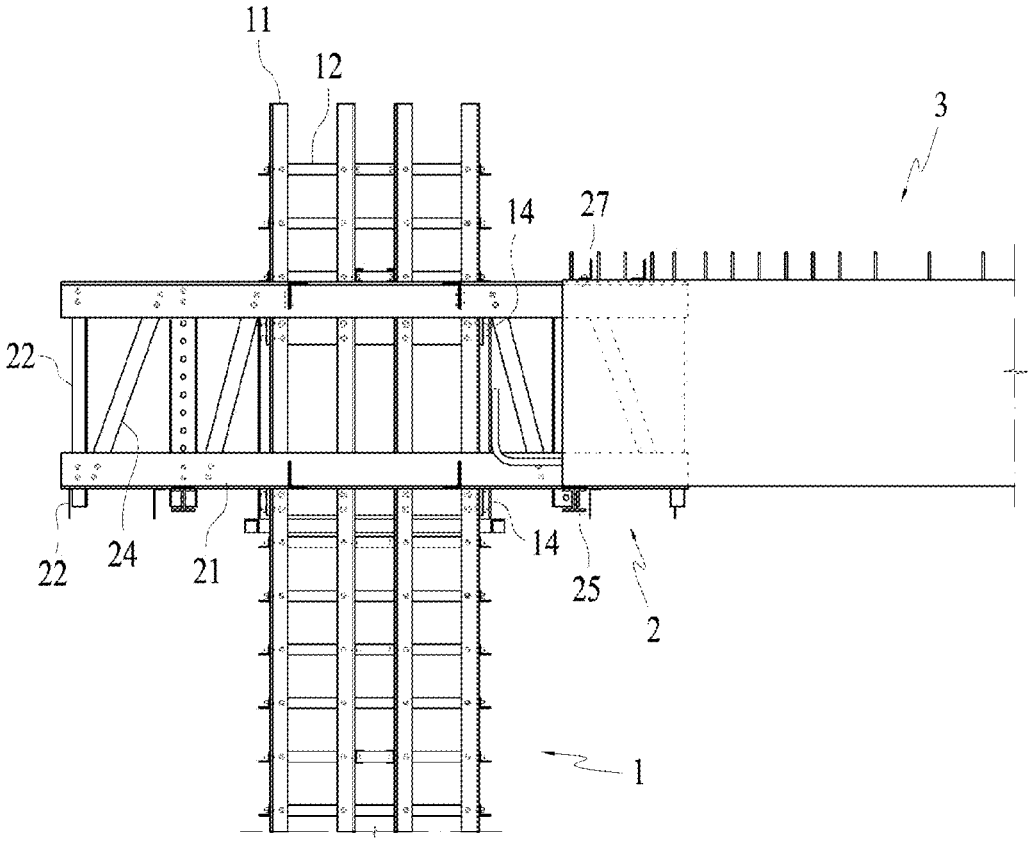
FIG. 8 is a side view showing a combined state of a prefabricated bracket assembly and a PC beam.
Figure 9:
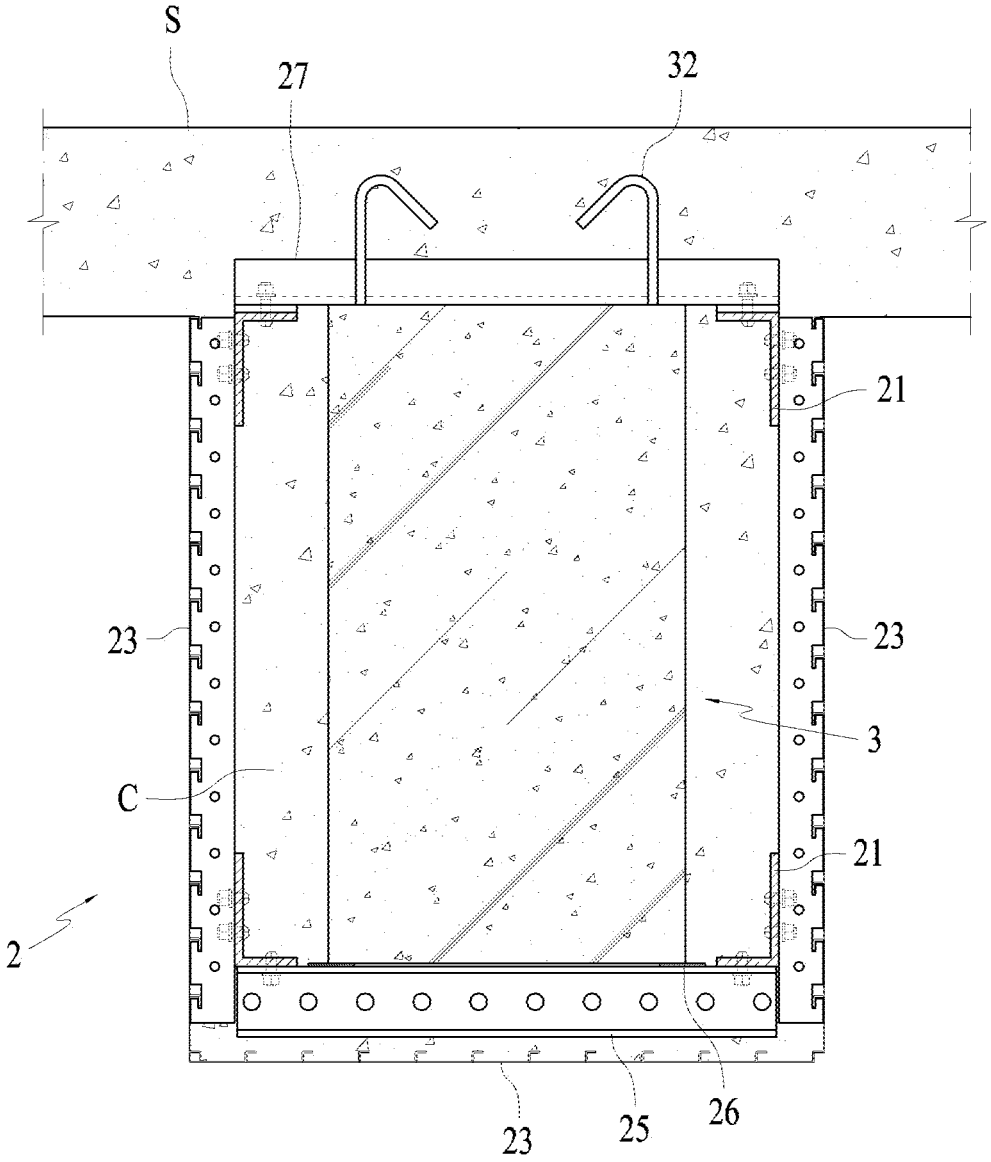
FIG. 9 is a cross-sectional view showing a PC beam seated in a prefabricated bracket assembly.
Figure 10:
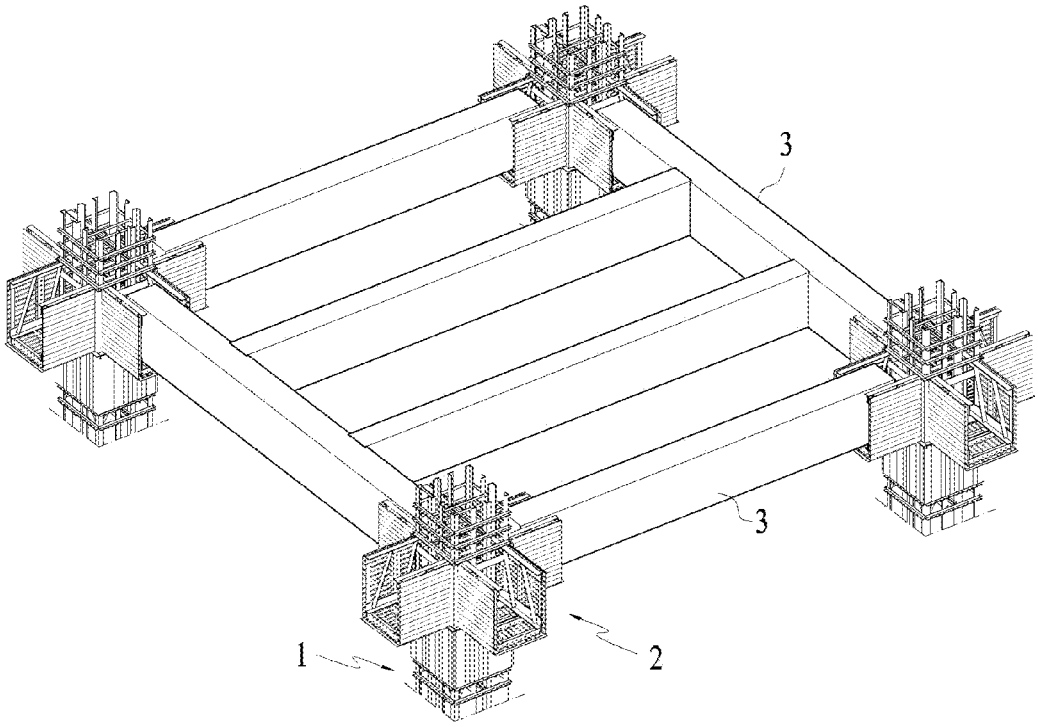
FIG. 10 is a perspective view showing a composite frame constructed according to the present invention.

FIG. 1 is a perspective view showing a prefabricated column assembly integrally equipped with a prefabricated bracket assembly before joining a lightweight permanent formwork, FIG. 2 is a perspective view showing a prefabricated column assembly integrally equipped with a prefabricated bracket assembly after joining a lightweight permanent formwork, FIG. 3 is a plan cross-sectional view showing a prefabricated column assembly, and FIG. 4 is a plan view showing prefabricated bracket assemblies in a state combined with a prefabricated pillar assembly. In addition, FIG. 5 is a cross-sectional view showing a cross-section taken along line A-A' in FIG. 4, and FIG. 6 is a cross-sectional view showing a cross-section taken along line B-B' in FIG. 4. In addition, FIG. 7 is a side view showing a joining process of a prefabricated bracket assembly and a PC beam, FIG. 8 is a side view showing a combined state of a prefabricated bracket assembly and a PC beam, FIG. 9 is a cross-sectional view showing a PC beam seated in a prefabricated bracket assembly, and FIG. 10 is a perspective view showing a composite frame constructed according to the present invention.

As shown in FIG. 1 to FIG. 10, a Prefabricated bracket assembly integrated to a prefabricated column assembly for connecting PC beams according to the present invention is formed in a U shape with an open top portion and integrally provided with a prefabricated column assembly 1 so as t connect a PC beam 3 to the prefabricated column assembly 1 that includes first connecting bars 12 connected to outer surfaces of vertical steel members 11, thereby interconnecting a plurality of vertical steel members 11 arranged in the vertical direction at each corner of a column member and neighboring vertical steel members 11, and includes: four horizontal steel members 21, which are spaced apart from each other in the up, down, left, and right directions, and penetrate a prefabricated column assembly 1 in the horizontal direction so that both ends protrude to the outside of side surfaces of the prefabricated column assembly 1; second connecting bars 22 for connecting horizontal steel members 21 neighboring in the up and down directions and horizontal steel members 21 neighboring in the left and right directions at the bottom, respectively; and lightweight permanent formworks 23 coupled to the outside of the second connecting bars 22 on each face of side portions and lower portions of the horizontal steel members 21, wherein with end portion of a PC beam 3 accommodated inside, concrete C is poured inside the lightweight permanent formworks 23 so that the PC beam 3 is joined.

The present invention is to provide a Prefabricated bracket assembly integrated to a prefabricated column assembly for connecting PC beams, which can easily join a PC beam 3 to a factory-made prefabricated column assembly 1 and reduce the amount of steel member, thereby reducing costs.

Such prefabricated bracket assemblies 2 are integrally assembled on upper portions of prefabricated column assemblies 1, allowing PC beams 3 to be easily joined between prefabricated bracket assemblies 2 on upper portions of neighboring prefabricated column assemblies 1.

Concrete C is poured inside the prefabricated column assembly 1 and the prefabricated bracket assembly 2, which are integrally assembled, thereby forming a composite frame (FIG. 10).

The prefabricated column assembly 1, which is integrally equipped with the prefabricated bracket assembly 2, is manufactured in advance at a factory, etc. so as to form a steel composite concrete member.

The prefabricated column assembly 1 includes vertical steel members 11 disposed in the vertical direction at each corner of a column member.

The vertical steel members 11 are disposed at a predetermined distance inward from member surfaces.

The vertical steel members 11 neighboring each other are interconnected by first connecting bars 12 provided in the transverse direction of the column member.

Angle members can be used as the vertical steel members 11 and the first connecting bars 12.

The first connecting bars 12 can be fixed to outer surfaces of the vertical steel members 11 by bolting, etc.

The vertical steel members 11 are embedded inside concrete and serve as main bars of a column, and first connecting bars 12 serve as stirrups.

Lightweight permanent formworks 13 may be provided on the outside of the prefabricated column assembly 1 (FIG. 2 and FIG. 3).

The lightweight permanent formworks 13 can be connected to the first connecting bars 12.

To this end, L-shaped or T-shaped locking protrusion parts 131 are formed on rear surfaces of the lightweight permanent formworks 13, and the first connecting bars 12 have locking groove parts 121 through which the locking protrusion parts 131 are inserted so as to be locked.

The prefabricated bracket assemblies 2 are placed horizontally on the upper portion of the prefabricated column assembly 1 in a direction perpendicular to the prefabricated column assembly 1 (FIG. 1, FIG. 4, etc.).

The prefabricated bracket assemblies 2 are provided in numbers of 1 to 4 to correspond to number and direction of beams coupled to the prefabricated column assembly 1.

Such a prefabricated bracket assembly 2 includes a plurality of horizontal steel members 21 that serve as main bars, second connecting bars 22 that stirrups and connect neighboring horizontal steel members 21 across the neighboring horizontal steel members 21, and lightweight permanent formworks 23 joined to the outside of the second connecting bars 22.

The four horizontal steel members 21 are provided to be spaced apart from each other in the up, down, left and right directions.

The horizontal steel members 21 penetrate the prefabricated column assembly 1 in the horizontal direction, wherein both ends of the horizontal steel members 21 protrude outward from side surfaces of the prefabricated column assembly 1.

The second connecting bars 22 interconnect horizontal steel members 21 neighboring in the up and down directions and horizontal steel members 21 neighboring in the left and right directions at the bottom, respectively (FIG. 5, etc.).

That is, the second connecting bars 22 are provided on the outside of both side surfaces and lower surface of the prefabricated bracket assembly 2, so that the prefabricated bracket assembly 2 is formed as a whole in a "U" shape with an open top portion.

The lightweight permanent formworks 23 are provided on each face of side portions and lower portions of the horizontal steel members 21.

That is, the lightweight permanent formworks 23 are also coupled to outer surfaces of upper and lower horizontal steel members 21 and to lower surfaces of the horizontal steel members 21 on both sides at the bottom, thereby forming as a whole a "U" shape with an open top portion.

The lightweight permanent formworks 13 are coupled to the outside of the second connecting bars 22.

To this end, L-shaped or T-shaped locking protrusion parts 231 are formed on rear surfaces of the lightweight permanent formworks 23, and the second connecting bars 22 have locking groove parts 221 through which the locking protrusion parts 231 are inserted so as to be locked.

In a state where an end portion of a PC beam 3 is received inside the prefabricated bracket assembly 2 so as to be mounted on upper surfaces of support pads 26 on the mounting bar 25, which will be described hereinafter, the PC beam 3 can be joined to the prefabricated column assembly 1 by pouring concrete C inside the lightweight permanent formworks 23.

The PC beam 3 can be constructed by installing one pair of prefabricated column assemblies 1 integrally equipped with prefabricated bracket assemblies 2 spaced apart from each other.

Herein, end portions of the PC beams 3 are inserted through the open top portions of the prefabricated bracket assemblies 2 (FIG. 7) and mounted inside the prefabricated bracket assemblies 2 (FIG. 8). Accordingly, the horizontal steel members 21 of the prefabricated bracket assemblies 2 overlap the end portions of the PC beams 3 by a certain length.

In a state where an end portion of a PC beam 3 is inserted and accommodated inside the prefabricated bracket assembly 2, the PC beam 3 and the prefabricated bracket assembly 2 can be integrated by pouring concrete C inside the lightweight permanent formworks 23 of the prefabricated bracket assembly 2 (FIG. 9).

A plurality of stud bolts SB may be coupled to the horizontal steel members 21 and the second connecting bars 22 for the purpose of integration with concrete C (FIG. 4, etc.).

The PC beam 3 may be provided with end portion anchors 31 that protrude so as to be anchored inside concrete C poured inside a prefabricated bracket assembly 2 (FIG. 7 and FIG. 8).

Thus, in the present invention, a PC beam 3 and a refabricated bracket assembly 2 can be integrated by simply mounting the PC beam 3 inside the prefabricated bracket assembly 2 and then pouring concrete C, without a separate joining process. Therefore, column-beam joining can be carried out very simply and quickly, while minimizing the burden on lifting equipment. Additionally, because work at heights can be reduced, there is no risk of worker safety accidents. Furthermore, it is easy to manufacture the prefabricated bracket assembly 2, and the cost can be reduced by saving the amount of steel members required during manufacture.

Meanwhile, both side surfaces of the prefabricated bracket assembly 2 may be provided with diagonal members 24 for connecting upper and lower horizontal steel members 21.

Herein, a truss structure may be formed by connecting end portions of the diagonal members 24 to points where second connecting bars 22 are joined to horizontal steel members 21.

The diagonal members 24 are provided to be inclined outward and downward so as to stably support load of a PC beam 3 mounted on a prefabricated bracket assembly 2.

As shown in FIG. 6, etc., a mounting bar 25 with a cross-section larger than that of a second connecting bar 22 may be provided on lower portions of one pair of horizontal steel members 21 positioned at the bottom so as to cross the one pair of horizontal steel members 21.

In order to support a PC beam 3 accommodated and mounted inside the prefabricated bracket assembly 2, a mounting bar 25 can be fixedly installed between one pair of left and right horizontal steel members 21 positioned at the bottom so as to cross the horizontal steel members 21.

Since the second connecting bar 22 serves as a stirrup for tensile force of members, the cross-sectional size of the second connecting bar 22 does not need to be large. In contrast, since the mounting bar 25 must support the load of a PC beam 3 by bending stress, the cross-sectional size of the mounting bar 25 is made larger than that of the second connecting bar 22.

The mounting bar 25 may be formed of a U-shaped steel material or, an H-shaped steel material, or with an H-shaped cross section formed by attaching one pair of right and left U-shaped steel materials.

A support pad 26 may be provided on an upper surface of the mounting bar 25 so as to prevent damage or slippage of a member when mounting a PC beam 3 on an upper portion of the mounting bar 25.

An upper support bar 27, which prevents a PC beam 3 received inside from falling off, may be provided on top of one pair of horizontal steel members 21 located at the top so as to cross an upper portion of the PC beam 3 (FIG. 8 and FIG. 9).

The prefabricated bracket assembly 2 is formed in a "U" shape with an open top portion. Accordingly, when PC slabs or deck plates are mounted on both sides of the prefabricated bracket assembly 2 or when concrete is poured, lightweight permanent formworks 23 on both sides may spread outward due to lateral pressure.

In order to prevent this spreading of the lightweight permanent formworks 23, after inserting an end portion of a PC beam 3 into the prefabricated bracket assembly 2, neighboring upper horizontal steel members 21 of the prefabricated bracket assembly 2 can be interconnected by installing an upper support bar 27 on top of the neighboring upper horizontal steel members 21 so as to across the upper horizontal steel members 21.

The upper support bar 27 presses an upper portion of the PC beam 3, of which end portion is accommodated inside the prefabricated bracket assembly 2. Accordingly, it is possible to fix position of the PC beam 3 and prevent the PC beam 3 from falling off.

The upper support bar 27 serves as a stirrup of a steel composite concrete member together with second connecting bara 22.

In addition, the upper support bar 27 is suspended between a plurality of upper anchoring bars 32 protruding above the PC beam 3 so as to fix the position of the PC beam 3.

Meanwhile, seats 14, on which the horizontal steel members 21 are mounted, may be horizontally coupled to one pair of vertical steel members 11 of the prefabricated column assembly 1 on side surfaces where the prefabricated bracket assembly 2 is coupled (FIG. 1, FIG. 8, etc.).

The prefabricated column assembly 1 and the prefabricated bracket assembly 2 become a structure integrated with each other by concrete C poured integrally inside. However, measures are needed to fix them separately before pouring concrete.

Therefore, seats 14 are coupled to side surfaces of the prefabricated column assembly 1 so as to cross neighboring one pair of vertical steel members 11 of the prefabricated column assembly 1, and horizontal steel members 21 of a prefabricated bracket assembly 2 can be mounted on the seats 14.

Since the horizontal steel members 21 are respectively provided at upper and lower portions of a prefabricated bracket assembly 2, the seats 14 can also be provided as a pair spaced apart from each other in the upper and lower directions so as to correspond to the horizontal steel members 21.

In order to fix the horizontal steel members 21 mounted on the seats 14, first connecting bars 12 can be installed on the upper horizontal steel members 21 in close contact with the upper horizontal steel members 21.

The seats 14 can be fixed to the vertical steel members 11 by welding, bolting or the like.

INDUSTRIAL APPLICABILITY

According to the present invention, a Prefabricated bracket assembly integrated to a prefabricated column assembly for connecting PC beams has industrial applicability in that PC beams s can be quickly and easily joined to factory-made prefabricated column assemblies, improving constructability, and the burden of lifting equipment can be minimized, reducing the risk of worker safety accidents.

The invention claimed is:

1. In a prefabricated bracket assembly (2), which is formed in a U shape with an open top portion and integrally provided with a prefabricated column assembly (1) to connect a precast concrete beam (3) to the prefabricated column assembly (1) that includes first connecting bars (12) connected to outer surfaces of vertical steel members (11), thereby interconnecting a plurality of vertical steel members (11) arranged in the vertical direction at each corner of a column member and neighboring vertical steel members (11), the prefabricated bracket assembly (2) integrated to the prefabricated column assembly (1) to connect the precast concrete beam (3), comprising:

four horizontal steel members (21), which are spaced apart from each other in the up, down, left, and right directions, and penetrate a prefabricated column assembly (1) in the horizontal direction so that both ends protrude to the outside of side surfaces of the prefabricated column assembly (1);

second connecting bars (22) for connecting horizontal steel members (21) neighboring in the up and down directions and horizontal steel members (21) neighboring in the left and right directions at the bottom, respectively;

lightweight permanent formworks (23) coupled to the outside of the second connecting bars (22) on each face of side portions and lower portions of the horizontal steel members (21);

a mounting bar (25), which are provided at lower portions of one pair of horizontal steel members (21) located at the bottom to cross the one pair of horizontal steel members (21) and has a cross-sectional size larger than that of the second connecting bars (22);

support pads (26) provided on an upper surface of the mounting bar (25);

an upper support bar (27), which is provided on upper portions of one pair of horizontal steel members (21) located at the top to cross upper portion of the precast concrete beam (3) and prevents the precast concrete beam (3) accommodated inside from falling off or the lightweight permanent formworks (23) from spreading out; and seats (14), which are horizontally coupled to one pair of the vertical steel members (11) of the prefabricated column assembly (1) on each side surface, where each of the prefabricated bracket assemblies (2) is coupled, and are spaced apart from each other in the up and down directions, so that the upper and lower horizontal steel members (21) are mounted on the seats (14), respectively, wherein with end portion of the precast concrete beam (3) accommodated inside to be mounted on upper surfaces of the support pads (26) on the mounting bar (25), concrete (C) is poured inside the lightweight permanent formworks (23) so that the precast concrete beam (3) is joined.

* * * * *